US006209793B1

(12) United States Patent
Taguchi

(10) Patent No.: US 6,209,793 B1
(45) Date of Patent: Apr. 3, 2001

(54) THERMOSTATIC EXPANSION VALVE IN WHICH A VALVE SEAT IS MOVABLE IN A FLOW DIRECTION OF A REFRIGERANT

(75) Inventor: Yukihiko Taguchi, Maebashi (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/349,102

(22) Filed: Jul. 8, 1999

(30) Foreign Application Priority Data

Jul. 8, 1998 (JP) ..... 10/192628

(51) Int. Cl.[7] ..... F25B 41/04
(52) U.S. Cl. ..... 236/92 B; 62/225
(58) Field of Search ..... 236/92 B; 62/225

(56) References Cited

U.S. PATENT DOCUMENTS

| | | | | |
|---|---|---|---|---|
| 4,032,070 | * | 6/1977 | Nielsen | 62/225 |
| 4,330,999 | | 5/1982 | Nakayama . | |
| 4,342,421 | * | 8/1982 | Widdowson | 236/92 B |
| 4,500,035 | * | 2/1985 | Kuroda et al. | 62/225 |
| 4,505,122 | | 3/1985 | Inomata . | |
| 4,840,039 | | 6/1989 | Kazuhiko . | |
| 4,882,909 | | 11/1989 | Terauchi . | |
| 4,905,477 | | 3/1990 | Kazuhiko . | |
| 5,025,636 | | 6/1991 | Terauchi . | |
| 5,027,612 | | 7/1991 | Terauchi . | |
| 5,168,716 | | 12/1992 | Terauchi . | |
| 5,189,886 | | 3/1993 | Terauchi . | |
| 5,251,459 | * | 10/1993 | Grass et al. | 236/92 B |
| 5,303,864 | * | 4/1994 | Hirota | 62/225 |
| 5,688,111 | | 11/1997 | Takai . | |
| 5,873,706 | | 2/1999 | Kawabata . | |

FOREIGN PATENT DOCUMENTS 0704622 4/1996 (EP) .

* cited by examiner

*Primary Examiner*—William E. Tapolcai
(74) *Attorney, Agent, or Firm*—Baker Botts L.L.P.

(57) ABSTRACT

In a thermostatic expansion valve having a refrigerant passage (11) for guiding a refrigerant in a predetermined direction, a seat member (209) is placed in the refrigerant passage to divide the refrigerant passage into a high-pressure chamber (10) and a low-pressure chamber (14). The seat member is movable in the predetermined direction and provided with a valve seat (200*a*). An urging arrangement (210) urges the seat member towards the high-pressure chamber. In the high-pressure chamber, a valve body (201) is movable for adjusting a flow of the refrigerant in cooperation with the valve seat. A control arrangement (205, 206, 207, 208) controls movement of the valve body in response to temperature of the refrigerant.

7 Claims, 5 Drawing Sheets

EARLIER TECHNOLOGY

EARLIER TECHNOLOGY

THERMOSTATIC EXPANSION VALVE IN WHICH A VALVE SEAT IS MOVABLE IN A FLOW DIRECTION OF A REFRIGERANT

BACKGROUND OF THE INVENTION

The present invention relates to a thermostatic expansion valve which is extensively but primarily used for a refrigeration cycle system such as automotive air conditioning apparatus.

Such a thermostatic expansion valve is included in a refrigeration cycle and is for expansion of a refrigerant which is contained in the refrigeration cycle. The thermostatic expansion valve in an earlier technology comprises a refrigerant passage for guiding the refrigerant in a predetermined direction, a valve seat dividing the refrigerant passage into a high-pressure chamber and a low-pressure chamber, a valve body movable in the high-pressure chamber for adjusting a flow of the refrigerant in cooperation with the valve seat, and a control arrangement for controlling movement of the valve body in response to temperature of the refrigerant.

With reference to FIG. 4, description will be made as a thermostatic expansion valve of the type described above. The thermostatic expansion valve is generally used for automotive or car air conditioning system employing a volume valuable compressor of a piston stroke controlling type such as a swash plate type compressor.

The thermostatic expansion valve has a casing 1, an expansion valve unit 2 and a closure member 3 in the casing 1. In a casing 1, there are provided a high-pressure passage 11 which serves as the refrigerant passage directing to an evaporator 4 for a high pressure refrigerant which is discharged from a compressor discharging chamber, low-pressure passages 12, 12 which serve as a passage directing to a compressor suction chamber for a low pressure refrigerant which is discharged from the evaporator 4, and a valve unit insertion portion 13 which is disposed between the low-pressure passages 12. The closure member 3 is located at an upper portion of the valve unit insertion portion 13 such that an end of the expansion valve 2 is adaptable by the use of engagement member.

The expansion valve unit 2 has a valve seat 200*a* which is located to form a high-pressure chamber 200*a* and a port 200*b* in the high-pressure passage 11 of the casing 1, a valve casing 200 disposed at a center of the casing 1 to close a passage between the high-pressure passage 11 and the valve unit insertion portion 13, a valve body 201 which is disposed in the high-pressure chamber 10 and contacted with, and spaced from, the valve seat 200*a* to open/close a passage directing to the evaporator 4 through the high-pressure passage 11, the valve seat 200*a*, and the port 200*b*, a spring 203 for biasing the valve body 201 toward a valve-closing direction (an upward direction in the illustration of FIG. 4) through a guide member 202, and an adjustment screw 204 for adjusting a pressing force of the spring 203. Further, there is disposed a temperature sensing portion 205 which is disposed in the valve unit insertion portion 13 of the casing 1 such that an end portion of the temperature sensing portion 205 is mounted to the closure member 3 and which is disposed in the midst of the low-pressure passage 12 directing from the outlet portion of the evaporator 4 to the suction (or inlet) chamber of the compressor and, in addition, a diaphragm 206 which is displaced in accordance with pressure difference between the inner pressure of the temperature sensing portion 205 and the pressure of the outlet of the evaporator 4, a transmission rod 207 which is displaceably supported to the valve casing 200 such that one end thereof is contacted with the diaphragm 206 and the other end is provided with the valve body 201 so that the valve body 201 is opened/closed in accordance with the displacement of the diaphragm 206, and a spring 208 for urging the transmission rod 207 toward the diaphragm 206. A combination of the temperature sensing portion 205, the diaphragm 206, the transmission rod 207, and the spring 208 is referred to as the control arrangement.

The expansion valve unit 2 has a passage 200*c* at the valve casing 200 so that the diaphragm 206 receives, or effected by, the pressure from the evaporator 4 by the passage 200*c*.

Within the temperature sensing portion 205 which is exposed to the refrigerant from the outlet of the evaporator 4, a refrigerant (R134a) and an adsorbent (oil) is sealed therein, and the pressure in the temperature sensing portion 205 is set to be varied in accordance with the temperature of the refrigerant from the outlet of the evaporator 4.

By the structure described above, a superheat degree characteristic is determined by a force due to a difference of the pressure added to both surfaces of the diaphragm 206 (that is, difference between a force for pressing the diaphragm 206 toward the valve body 201 and a force acting in the valve opening/closing direction of the valve body 201), and a spring force of the spring 203.

FIG. 5 shows a characteristic of temperature (° C.)-pressure (kg/cm$^2$G) under a predetermined pressure condition of the inlet of the thermostatic expansion valve described above. In FIG. 5, the characteristic C1 with respect to the expansion valve represents a linear line which shows that a pressure proportionally increases as the elevation of the temperature, whereas the characteristic C2 with respect to the refrigerant (R134a) represents a curve which shows that a pressure gradually varies and increases as the elevation of the temperature. As seen from FIG. 5, it is prescribed that the characteristic C1 extends across the characteristic C2.

Namely, in comparison between characteristic C1 and characteristic C2, if temperatures are compared with reference to pressure elevation up to 2.0 kg/cm$^2$G, the temperature of characteristic C1 represents ° C. whereas the temperature of characteristic C2 represents a temperature value slightly higher than ° C. However, if temperatures are then compared with reference to pressure elevation up to 2.7 kg/cm$^2$G, the temperature of characteristic C1 represents 10° C. whereas the temperature of characteristic C2 represents a temperature value lower than 10° C. by $\Delta T$. Thus, a relationship of the temperatures relative to the pressure is reversed at a temperature above ° C. and around 1.2° C. to form a break-even or cross-over point. This is aimed to obtain restriction of hunting of an expansion valve especially at a low and middle temperature range and returning of the refrigerant (including an oil) to the compressor, because the compressor is in a continuous operation to a low outdoor temperature range and a circulation amount of the refrigerant is extremely reduced in this region.

In case of the thermostatic expansion valve described above, the characteristic C1 of the expansion valve is located at a higher position than the characteristic C2 of the refrigerant in the region of lower temperature than the cross-point. In this state, the expansion valve is always opened, and the high pressure side and the low pressure side are not closed or cut off even in the suspended state of the compressor and, accordingly, the refrigerant which has been trapped at the high pressure side due to the change of the temperature in and out of the vehicle is moved to the low pressure side through the expansion valve so that it is likely that a great amount of the refrigerant is stored in the interior of the compressor itself and in its suction passage. If, in this state, the compressor is driven, liquid compression is generated to cause serious problems such as damage and breakage in the compressor. Accordingly, it is necessary that the cases that the liquid refrigerant is delivered from the thermostatic expansion valve side to the compressor itself and/or its suction passage must be avoided.

SUMMARY OF THE INVENTION

It is therefore an object of the present invention to provide a thermostatic expansion valve which can prevent any movement of the refrigerant from the high pressure side to the low pressure side in the low outdoor temperature region while a temperature-pressure characteristics are maintained.

Other objects of the present invention will become clear as the description proceeds.

According to the present invention, there is provided a thermostatic expansion valve included in a refrigeration cycle for expansion of a refrigerant which is contained in the refrigeration cycle. The thermostatic expansion valve comprises a refrigerant passage for guiding the refrigerant in a predetermined direction, a valve seat dividing the refrigerant passage into a high-pressure chamber and a low-pressure chamber, a valve body movable in the high-pressure chamber for adjusting a flow of the refrigerant in cooperation with the valve seat, and control means for controlling movement of the valve body in response to temperature of the refrigerant. The thermostatic expansion valve further comprises a seat member placed between the high-pressure and the low-pressure chambers to be movable in the predetermined direction. The seat member is provided with the valve seat. The thermostatic expansion valve further comprises urging means connected to the seat member for urging the seat member towards the high-pressure chamber.

DESCRIPTION OF THE PREFERRED EMBODIMENT

Figure 1:
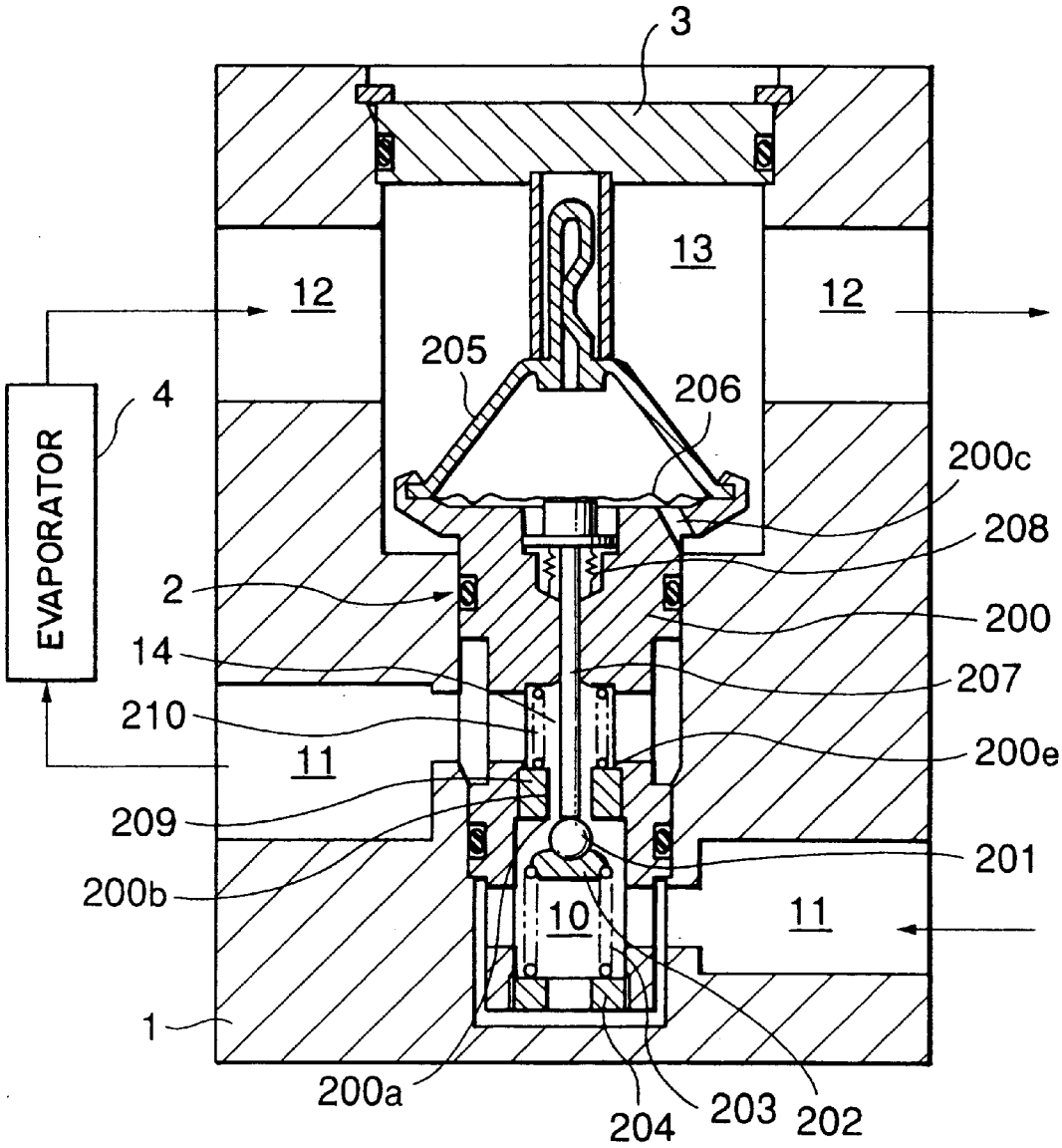
FIG. 1 is a sectional elevation of a thermostatic expansion valve according to an embodiment of the present invention, showing a basic structure thereof.

With reference to FIG. 1, the description will be made as regards a thermostatic expansion valve according to an embodiment of the present invention. Similar parts are designated by like reference numerals.

The thermostatic expansion valve is included in a refrigeration cycle 5 and is for expansion of a refrigerant which is contained in the refrigeration cycle 5. The thermostatic expansion valve is suitable for air conditioning system in automobiles.

In the expansion valve unit 2, a low-pressure chamber 14 is separately confined from the high-pressure chamber 10. The low-pressure and the high-pressure chambers 14 and 10 are communicated with the high-pressure passage 11. A combination of the low-pressure and the high-pressure chambers 14 and 10 is referred to as a refrigerant passage which is for guiding the refrigerant in a predetermined direction.

The valve casing 200 is disposed at a central portion of the casing 1 and is for closing or cutting off a passage between the high-pressure passage 11 and the valve unit insertion portion 13. The valve body 201 is disposed in the high-pressure chamber 10 and is for opening/closing the high-pressure passage directing to the evaporator 4. The spring 203 is for urging the valve body 201 in a valve-closing direction through the guide 202. The adjustment screw 204 is for adjusting spring force of the spring 203.

The temperature sensing portion 205 is disposed in the low-pressure passage 12 directing from the outlet of the evaporator 4 to the compressor suction chamber. An upper end of the temperature sensing portion 205 is mounted to the closure member 3 in the valve unit insertion portion 13. The diaphragm 206 is displaceable in accordance with difference between the pressure in the temperature sensing portion 205 and the pressure of the outlet of the evaporator 4. The transmission rod 207 is movably supported by the valve casing 200 and is for opening and closing the valve body 201 in accordance with the displacement of the diaphragm 206. The transmission rod 207 is contacted at its end to the diaphragm 206 and fixed at its other end to the valve body 201. The spring 208 is for urging the transmission rod 207 against the diaphragm 206.

The expansion valve unit 2 of the thermostatic expansion valve further comprises a seat member 209 placed between the high-pressure and the low-pressure chambers 10 and 14 and a compression spring 210 interposed between the valve casing 200 and the seat member 209. The seat member 209 is movable in the predetermined direction and is provided with the valve seat 200*a* facing the valve body 201 and surrounding the port 200*b*. Here, the seat member 209 is in contact with the valve member 201 when the pressure difference between the high-pressure chamber 10 and the low-pressure chamber 14 is below a predetermined value which is determined in relation to spring force of the compression spring 210. So that, the seat member 209 serves to prevent the high pressure refrigerant from flowing into the evaporator 4.

The compression spring 210 is disposed in the low-pressure chamber 14 and is for urging the seat member towards the high-pressure chamber 10 or the valve body 201. The compression spring 210 is referred to as an urging arrangement.

Figure 2:
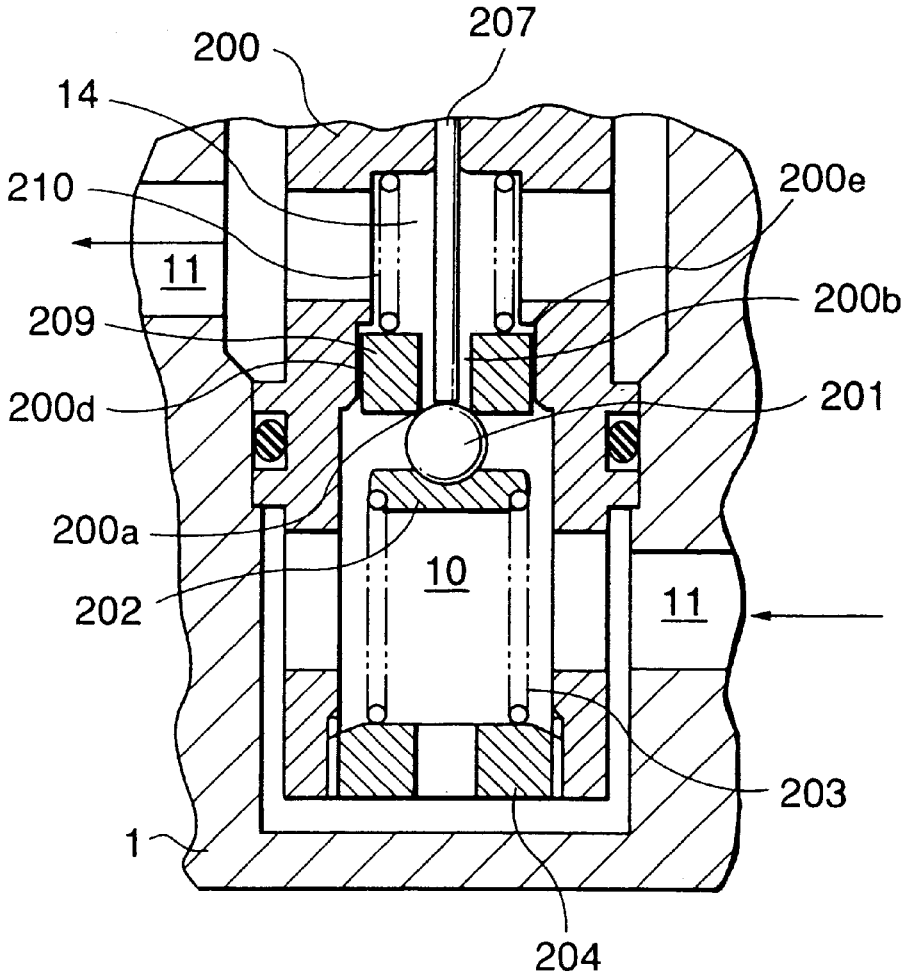
FIG. 2 is an enlarged sectional view of a part of a principal portion of the thermostatic expansion valve shown in FIG. 1.

With reference to FIG. 2, the description will be proceeded. The expansion valve unit 2 of the thermostatic expansion valve further comprises a stopper 200*e* for preventing the seat member 209 from movement thereof towards the low-pressure chamber 14 in the predetermined direction. Therefore, the seat member 209 is kept in contact with the stopper 200*e* when the pressure difference between the high-pressure chamber 10 and the low-pressure chamber 14 is above the predetermined value.

Incidentally, a gap between the seat member 209 and the valve casing 200 is formed minimum to prevent any leakage of the refrigerant. A relationship among a pressing force (f1) of the spring 203, a pressing force (f2) of the spring 210, and a pressing force (f3) of the spring 208 is determined as f1>f2>f3.

In the structure described above, a refrigerant (R134a) and an adsorbent are sealed in the temperature sensing portion

205 which is exposed to the refrigerant discharged from the outlet of the evaporator 4, and a pressure in the temperature sensing portion 205 varies in accordance with the temperature of the refrigerant discharged from the outlet of the evaporator 4. In this case, the seat member 209 is displaced in the up-down direction on the sheet-surface of FIG. 1 of the drawing by a magnitude of the pressure difference (Δp) between the high-pressure chamber 10 and the low-pressure chamber 14 and a spring force of the spring 210.

In other words, if a force by the pressure difference (Δp) is larger than the spring force of the spring force 210, the seat member 209 is moved upward on the sheet-surface of FIG. 1 and then contacted with the stopper 200*e* of the valve casing 200. In this state, the seat member 209 is integral with the valve casing 200 and, therefore, the same functions (a characteristic of superheat degree) as in the conventional expansion valve can be obtained. Accordingly, in the state described above, a characteristic of superheat degree is determined primarily by a force of the pressure difference relative to the both surfaces of the diaphragm 206 (that is, a difference between a force urging the diaphragm 206 against the valve body 201 and a force affecting in the valve-closing direction of the valve body 201), and a spring force of the spring 203.

If, on the other hand, the pressure difference (Δp) is smaller than the spring force of the spring 210, the seat member 209 is displaced downward on the sheet-surface of FIG. 1 while the valve body 201 is opened, and then contacted with the valve body 201 as shown in FIG. 2. Thus, the high-pressure passage 11 directing to the evaporator 4 is closed.

The pressure difference (Δp) becomes smaller as the outdoor temperature becomes lower and, therefore, if the seat member 209 is set to operate by a very small difference of pressure, the both high pressure side and the low pressure side are cut off when the outdoor temperature is low. A displacement of the refrigerant from the high-pressure side to the low pressure side in the range of low outdoor temperature while a temperature-pressure characteristic is maintained.

Figure 3:
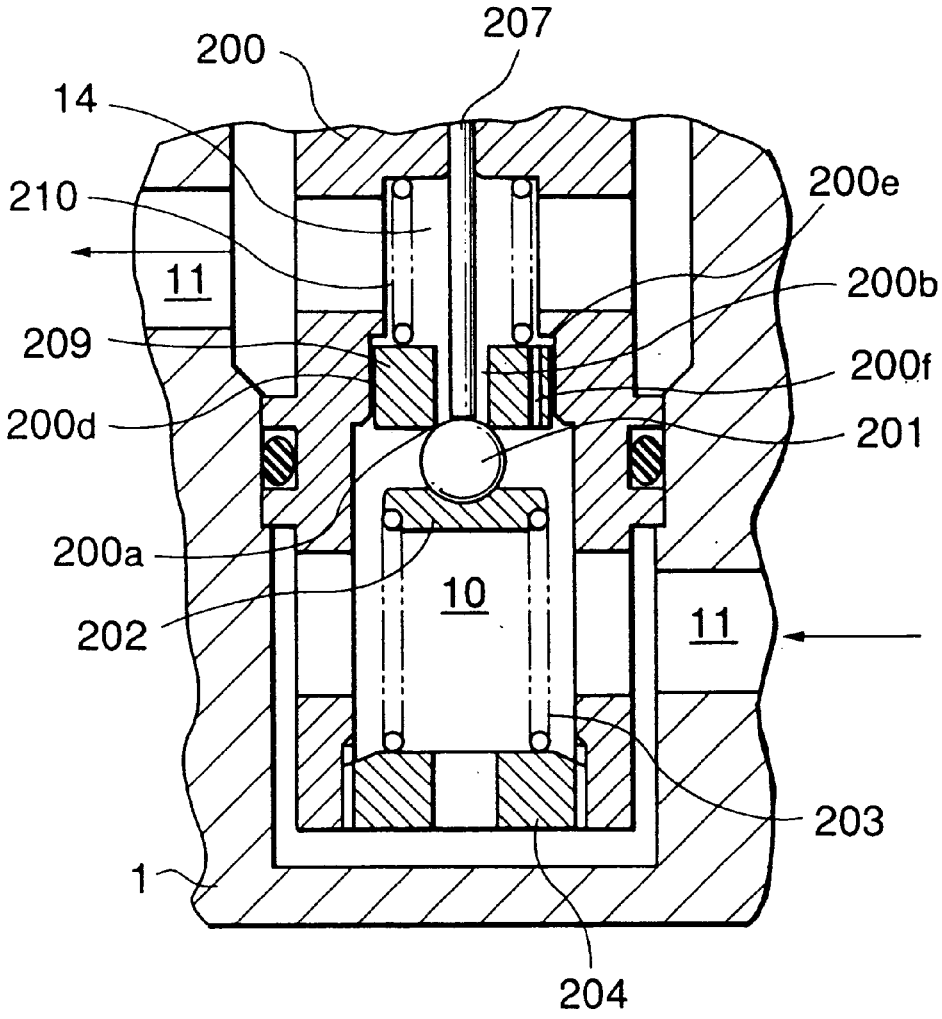
FIG. 3 is an enlarged sectional view of a part of a thermostatic expansion valve according to another embodiment of the invention.

With reference to FIG. 3, the description will be made as regards a thermostatic expansion valve according to another embodiment of the present invention. Similar parts are designated by like reference numerals.

In the thermostatic expansion valve, the seat member 209 has at least one orifice 200*f* which extends in the predetermined direction to communicate the high-pressure chamber 10 with the low-pressure chamber 14 at an outside of the valve seat 200*a*. The orifice 200*f* is referred to as a passage. The seat member 209 is in contact with the valve body 201 when the pressure difference between the high-pressure chamber and the low-pressure chamber is below the predetermined value. Even in this condition, a very small amount of the high pressure refrigerant is flown from the high-pressure chamber 10 to the low-pressure chamber 14 through the orifice 200*f* to limit the flow the high pressure refrigerant into the evaporator 4.

Figure 4:
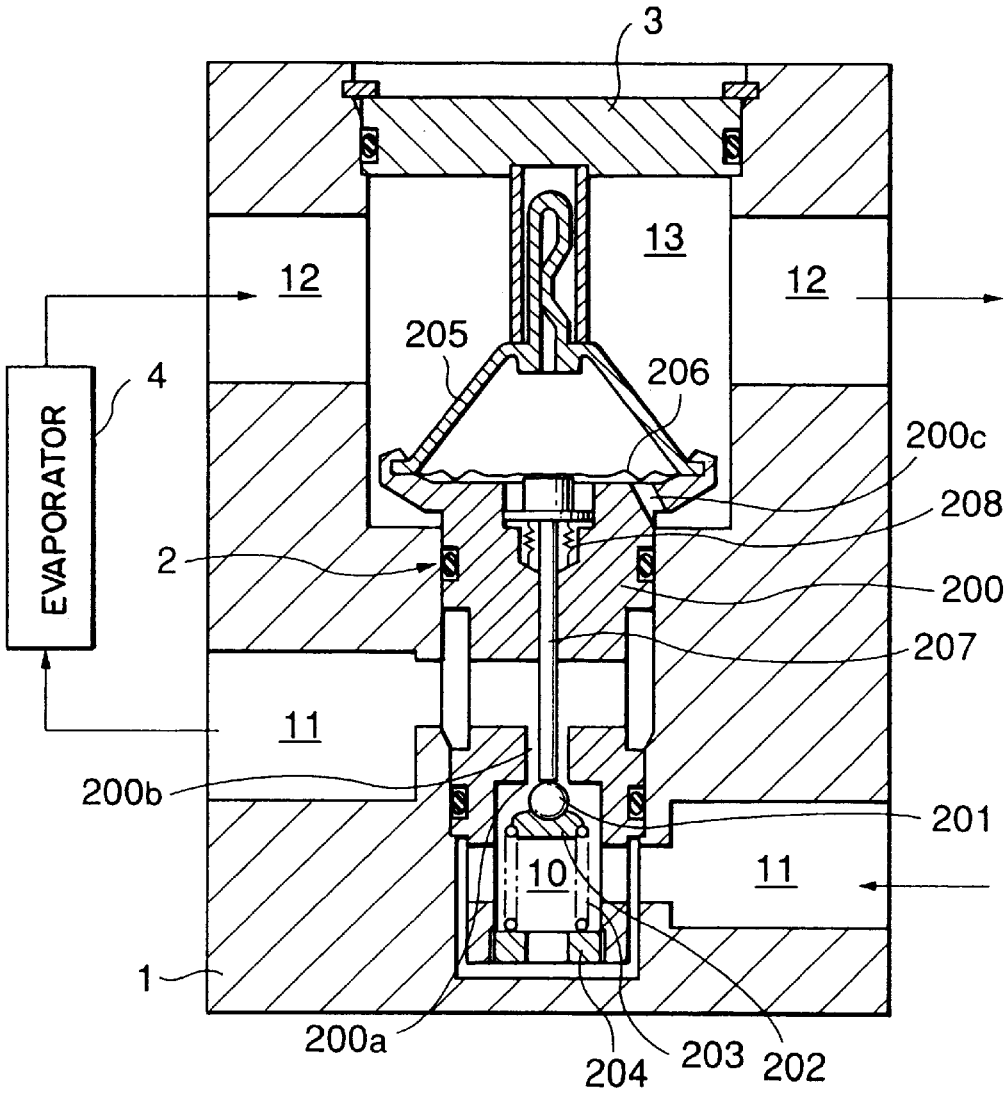
FIG. 4 is a sectional elevation of an example of the conventional thermostatic expansion valve in an earlier technology, showing a basic structure.
Figure 5:
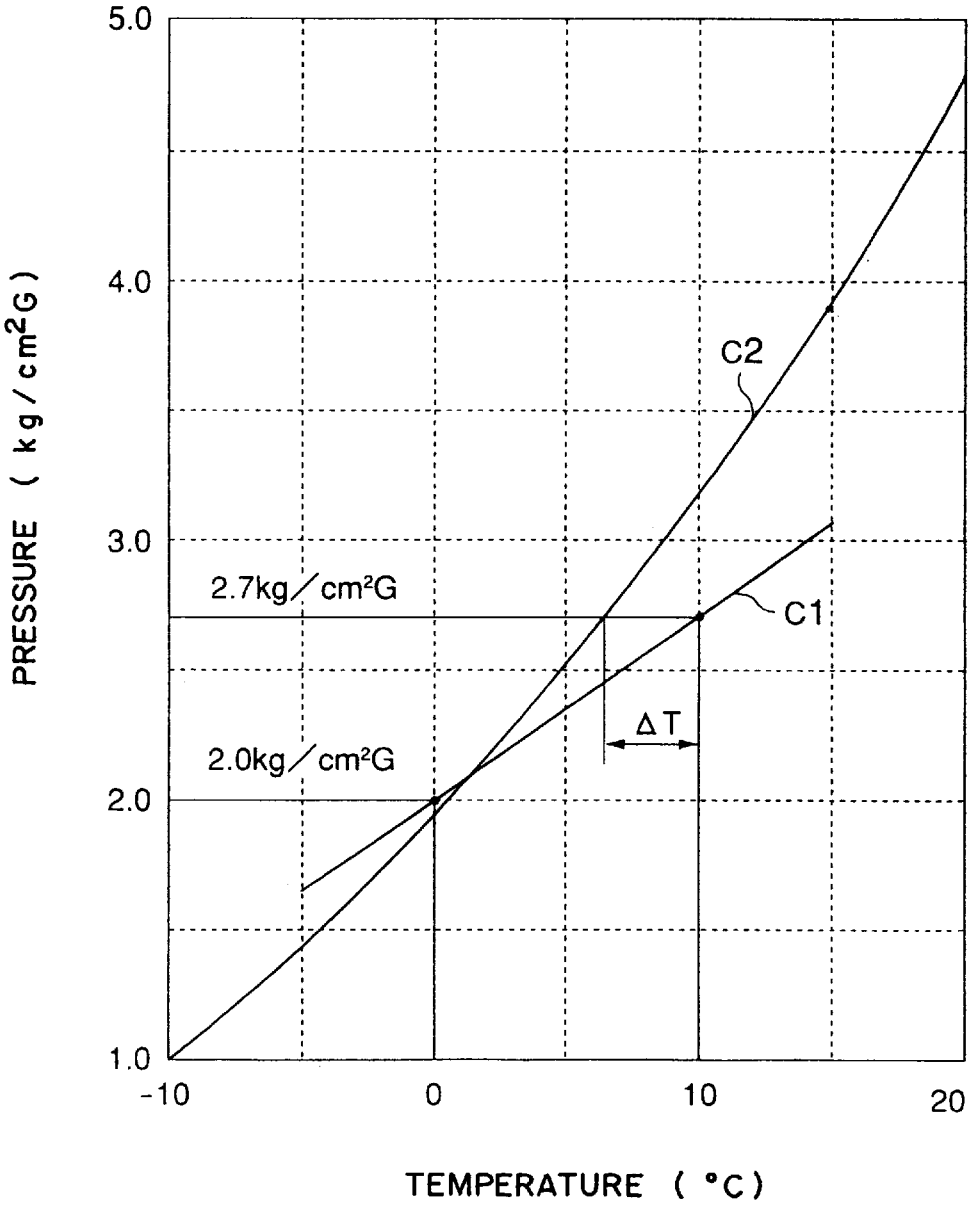
FIG. 5 is a graph showing temperature-pressure characteristics under a predetermined inlet pressure condition of the thermostatic expansion valve shown in FIG. 4.

In other words, though the high-pressure passage 11 directing to the evaporator 4 is not completely cut off due to the existence of the orifice 200*f* while the seat member 209 is in contact with the valve body 201. However, an opening area of the orifice 200*f* is satisfactorily small enough relative to the opening area of the port 200*b* and, therefore, a flow of the refrigerant from the high pressure side to the low pressure side is much more restricted than that of the structure shown in FIG. 4.

While the present invention has thus far been described in connection with a few embodiments thereof, it will readily be possible for those skilled in the art to put this invention into practice in various other manners. For example, a groove may be made instead of the orifice on the seat member to communicate the high-pressure chamber 10 with the low-pressure chamber 14 at the outside of the valve seat.

What is claimed is:

1. A thermostatic expansion valve included in a refrigeration cycle for expansion of a refrigerant which is contained in said refrigeration cycle, said thermostatic valve comprising:

a refrigerant passage for guiding said refrigerant in a predetermined direction;

a valve seat dividing said refrigerant passage into a high-pressure chamber and a low-pressure chamber;

a valve body movably disposed in said high-pressure chamber for adjusting a flow of said refrigerant in cooperation with said valve seat;

control means for controlling movement of said valve body in response to temperature of said refrigerant;

a seat member placed between said high-pressure and said low-pressure chambers to be movable in said predetermined direction, said seat member being provided with said valve seat, wherein said scat member is kept in contact with said valve body when a pressure difference between said high-pressure chamber and said low pressure chamber is below a predetermined value; and urging means connected to said seat member for urging said seat member towards said high-pressure chamber.

2. A thermostatic expansion valve as claimed in 1, wherein said urging means urges said seat member towards said high-pressure chamber to open said valve.

3. A thermostatic expansion valve as claimed in claim 1, further comprising a stopper for preventing said seat member from movement thereof towards said low-pressure chamber in said predetermined direction, said seat member being kept in contact with said stopper when the pressure difference between said high-pressure chamber and said low-pressure chamber is above a predetermined value.

4. A thermostatic expansion valve as claimed in claim 1, wherein said urging means comprises a spring member.

5. A thermostatic expansion valve as claimed in claim 1, wherein said seat member has a port communicating said high-pressure chamber with said low-pressure chamber, said valve seat facing said high-pressure chamber and surrounding said port.

6. A thermostatic expansion valve as claimed in claim 1, wherein said seat member further has a passage communicating said high-pressure chamber with said-low-pressure chamber at an outside of said valve seat.

7. A thermostatic expansion valve included in a refrigeration cycle for expansion of a refrigerant which is contained in said refrigeration cycle, said thermostatic valve comprising:

a refrigerant passage for guiding said refrigerant in a predetermined direction;

a valve seat dividing said refrigerant passage into a high-pressure chamber and a low-pressure chamber;

a valve body movably disposed in said high-pressure chamber for adjusting a flow of said refrigerant in cooperation with said valve seat;

control means for controlling movement of said valve body in response to temperature of said refrigerant;

a seat member placed between said high-pressure and said low-pressure chambers to be movable in said predetermined direction, said seat member being provided with said valve seat; and a first spring member for biasing said valve body toward a valve-closing direction, wherein said first spring member has pressing force f1;

urging means connected to said seat member for urging said seat member towards said high-pressure chamber, wherein said urging means comprises a second spring member, wherein said second spring member has pressing force f2;

a third spring member for urging a transmission rod toward a diaphragm, wherein said third spring member has pressing force f3; and wherein a relationship of f1>f2>f3 is established.

* * * * *